United States Patent [19]

Durham et al.

[11] Patent Number: 4,610,800

[45] Date of Patent: Sep. 9, 1986

[54] METHOD FOR UNCLOGGING DRAINAGE PIPES

[75] Inventors: Donald Durham, Germantown; J. Leslie Glick, Potomac; Douglas W. Fodge, Rockville; Wayne E. Swann, Columbia, all of Md.

[73] Assignee: Genex Corporation, Rockville, Md.

[21] Appl. No.: 695,219

[22] Filed: Jan. 25, 1985

[51] Int. Cl.[4] ..... C11D 7/42; D06M 16/00

[52] U.S. Cl. ..... 252/174.12; 252/174.17; 252/173; 252/DIG. 14; 435/264

[58] Field of Search ..... 252/174.12, DIG. 12, 252/174.17, 173; 435/264

[56] References Cited

U.S. PATENT DOCUMENTS

| | | | |
|---|---|---|---|
| 3,041,246 | 6/1962 | Bolaski et al. | 195/8 |
| 3,406,089 | 10/1968 | Yerkes | 435/364 |
| 3,506,582 | 4/1970 | Gertzman | 252/157 |
| 3,635,797 | 1/1972 | Battistoni et al. | 252/174.12 X |
| 3,746,649 | 7/1973 | Barret | 252/170 |
| 3,813,342 | 5/1974 | Cooperman | 252/170 |
| 3,966,543 | 6/1976 | Cayle et al. | 162/158 |
| 4,272,396 | 6/1981 | Fukano et al. | 252/174.12 |
| 4,435,307 | 3/1984 | Barbeagaard et al. | 252/174.12 |
| 4,443,355 | 4/1984 | Murata et al. | 252/174.12 |

OTHER PUBLICATIONS

ABIPC, vol. 51, No. 10 (Apr., 1981) Abstr. 9609.

ABIPC, vol. 48, No. 6 (Dec., 1977) 5695(M).

Soap & Chemical Specialties, "Biokem D," Jun. 1963, pp. 130, 131.

*Primary Examiner*—Prince E. Willis

*Attorney, Agent, or Firm*—Bernard, Rothwell & Brown

[57] ABSTRACT

Drainage pipes, such as toilet drains, which are clogged with cellulosic paper products, are unclogged by contacting the paper with a cellulase enzyme in the form of an aqueous solution, a viscous fluid comprising the enzyme dispersed in a non-cellulosic water-soluble natural or synthetic gum, or solid particles comprising the enzyme dispersed in a water-soluble polymer.

2 Claims, No Drawings

METHOD FOR UNCLOGGING DRAINAGE PIPES

BACKGROUND OF THE INVENTION

The present invention relates to methods and compositions useful in unclogging drainage pipes, such as toilets, which have become blocked with toilet paper and/or other cellulosic paper.

Toilet plumbing often becomes clogged with toilet paper and other paper material, thereby interfering with or preventing proper drainage of the toilet. In addition to toilet paper or tissues, other paper products such as paper towels, feminine hygiene napkins and tampons, etc., are frequently flushed down toilets, resulting in clogged drainage pipes. A variety of mechanical and chemical methods have traditionally been employed to unclog toilet plumbing. A common method of unclogging toilet plumbing has been the use of caustic chemicals. However, these products are only partially effective in clearing toilets and are capable of corroding the plumbing and causing injury to the user. Mechanical methods for improving water flow or unclogging toilets include the use of a plunger or a snake/auger. In severe cases, the toilet must be dismantled to remove the blockage. Therefore, the need for a product which will effectively decompose toilet paper and other cellulosic paper materials, thereby allowing the removal of drain blockages, still persists.

SUMMARY OF THE INVENTION

This invention provides a method for unclogging drainage pipes which are blocked by cellulosic paper materials which comprises contacting the paper with a cellulase enzyme, at a pH from about 4.5 to 8.5 in the amounts sufficient to digest the cellulose in the paper. There are also provided by the invention compositions containing a paper-decomposing amount of a cellulase enzyme dispersed a thickening agent, such as a natural or synthetic gum, or a water soluble polymer. The compositions of the invention allow the cellulase enzyme to penetrate standing water in the drain so that the enzyme is effectively delivered to the site of the drain clog.

DETAIL DESCRIPTION OF THE INVENTION

Cellulase is a term used to describe a group of enzymes which hydrolyze cellulose. Cellulose is a major component of paper products which frequently cause clogs in toilet drains. The protein components of the enzyme include endocellulases ($C_x$), exocellulases ($C_1$) and $\beta$-glucosidases (cellobiases). A description of these cellulase components is given by King and Vessal in a paper entitled "Enzymes of the Cellulase Complex" [*Advances in Chemistry,* Vol. 95, pp. 7–25 (1969)]. In the method of the invention, any of the cellulose hydrolytic enzymes may be used, alone or in combination. Additionally, enzymes such as hemicellulases and $\beta$-1,3-glucanases may be employed. Preferred cellulases for use in the method of the invention are those derived from microorganism of the genus Trichoderma, Chrysosporium, Penicillum, Fusarium, Thielavia, Sporotrichium, Bacillus, Cellulomonas, Ruminococcus and Clostridium.

Useful cellulases are available for many commercial sources, including "Cellulase Tv Concentrate" (Miles Laboratory), "Meicelase" (Meiji Seika Company Limited), "Cellulase 5000" (Veda Chemical Industries Company), "Celluclast ® 250 1" and "Celluclase ® 100 1" (Novo Laboratories Inc.).

In addition to the the cellulases and related hydrolytic enzymes, there will generally be present in the compositions of the invention a suitable buffering agent which maintains the pH from 4.5 to 8.5 depending on the source or the types of cellulose hydrolytic enzymes. The cellulase enzymes are active and stable at these pH levels. The compositions can also contain stabilizing agents for the cellulase enzymes. Preferred stabilizing agents are sorbitol and propylene glycol. The stabilizing agents, when present, are employed in the known effective amounts. Generally, the stabilizing agent is present at a concentration of from about 1.0% to 25% by weight, based on the weight of the enzyme.

In one embodiment of the invention, there is provided a composition for unclogging toilet drains in the form of a viscous fluid which comprises a buffered cellulase enzyme dispersed in a water soluble, non-cellulosic natural or synthetic gum. The gum acts as a thickening agent which allows the cellulase enzyme to be delivered effectively to the site of the drain clog through standing water. The gum matrix is then dissolved, allowing the enzyme to digest the cellulosic paper at the site of the drain clog. Cellulosic gums, e.g., carboxymethylcellulose or hydroxy propylmethylcellulose, are unsuitable for use in these compositions inasmuch as the cellulase enzyme would act to digest the gum and become unavailable to digest the paper clogging the drain. Suitable gums for use in the composition of the invention include those which are water soluble at room temperature and result in increased viscosity. One can mention, as merely illustrative of the gums which can be employed, natural gums such as xanthan gum, gum arabic, tragacanth gum, locust bean gum, guar gum, carrageenean, pectin, dextran, polysaccharide, B-1459, propyleneglycol alginate, carboxymethyl locust bean gum and carboxymethyl guar gum. In addition to the natural gums, one can also employ water soluble synthetic polymers such as fluid ethylene oxide polymers or polyethyleneimine.

The compositions can be prepared by dissolving a buffered solution of the cellulase enzyme in an aqueous solution containing the gum, using heat and/or mechanical mixing to assist in dispersion of the enzyme. Generally, the aqueous composition contains from about 0.1 to about 1.0 percent by weight of the natural or synthetic gum and from about 5 to about 20 percent of the cellulase enzyme.

In another embodiment of the invention, the cellulase is provided in the form of a composition comprising solid, water soluble particles, such as beads, formed by dispersing the cellulase enzyme in a water soluble polymer. An example of a suitable water soluble polymer is polyethylene glycol (PEG) having a molecular weight of from about 6000 to about 20,000. The weight ratio of enzyme to PEG can range from about 1:1 to about 1:1000. In addition to the enzyme and polymer, the bead may also contain water. Both the dissolution time and melt temperature are effected by the amount of moisture in the polymer. Generally, the moisture content is less than about 10% of the polymer by volume and preferably from about 0.01 to about 2%. The diameter can vary from less than ½ millimeter to greater than 7 millimeters. Preferably, the diameter is between about 0.5 milimeters and about 5 milimeters.

The enzyme maybe incorporated into the polymer in either liquid or solid form. To form the particles, the polymer is melted and then mixed with the liquid or solid form of the enzyme. The particles can then be formed in a variety of ways. For example, the polymer-enzyme mixture can be formed into droplets and then resolidified. Alternatively, the liquid mixture can be spread into a thin sheet which is ground into particles after it has resolidified. The material also can be extruded and then comminuted to the desired particle size using conventional sizing equipment.

The cellulase enzyme—in the form of an aqueous solution, a thickened fluid composition or solid particles—can be added directly to the bowl of the toilet containing the clogged drain or the composition can be provided directly to the site of the drain clog by means of a flexible tube connected to a means for injecting the composition into the clogged drain. Alternatively, the enzyme can be provided, in the form of a liquid composition, to the toilet reservoir tank using a device which continuously meters the composition into the reservoir so that the composition is released into the toilet drain after each flush. If desired, the cellulase enzyme can be admixed with a conventional toilet bowl cleaner, e.g., an anionic or nonionic surfactant and dispensed into the toilet drain periodically in order to remove cellulosic paper which may be lodged in the toilet drain while simultaneously cleaning the toilet. The mixture may be in the form of a solid or liquid.

The enzyme is provided to the site of the clog in a sufficient amount to digest the cellulose in the paper. Of course, the amount necessary will vary somewhat depending on the amount of paper product present, the type of paper, etc. We have found that a typical toilet drain badly clogged with toilet paper can be cleared in about 60 minutes using from about 15 to 75 units/ml of cellulase. One unit of cellulase is defined as the amount of enzyme required to produce one micromole per minute reducing carbohydrate.

The methods and compositions of the invention can be used in any conventional type of toilet, including those of the washdown, reverse trap, syphon jet and syphon vortex types. In addition, the methods and compositions of the invention can be used in vehicular toilets such as those found in boats, planes, campers, buses and trains.

The following examples are intended to further illustrate the practice of the invention and are not intended to limit the scope of the invention in any way.

EXAMPLE 1

Novo Celluclast ® 250 1, a buffered solution of cellulase enzyme, was diluted into 200 ml (final volume) deionized water (pH 5.5) in 1 liter breakers. Four and one-half grams either of Charmin ® toilet paper or Sof-Knit 198 ® toilet paper was added to the enzyme solutions. As controls, each type of paper was added to deionized water without enzyme. The reaction mixtures were incubated at 22° C. and the rate of decomposition was estimated visually. The results are expressed as percent decomposition for each dilution (Table 1).

TABLE 1

Decomposition of toilet paper by Novo celluclast ®

| | Treatment | | | | | |
|---|---|---|---|---|---|---|
| | Sof-Knit 198 ® | | | Charmin ® | | |
| Time (min.) | 1:40 | 1:100 | 1:1000 | 1:40 | 1:100 | 1:1000 |
| 5 | 80 | 50 | 5 | 85 | 50 | 5 |
| 10 | 95 | — | — | 100 | — | — |
| 20 | — | 80 | 10 | — | 80 | 25 |

TABLE 1-continued

Decomposition of toilet paper by Novo celluclast ®

| | Treatment | | | | | |
|---|---|---|---|---|---|---|
| | Sof-Knit 198 ® | | | Charmin ® | | |
| Time (min.) | 1:40 | 1:100 | 1:1000 | 1:40 | 1:100 | 1:1000 |
| 30 | — | 100 | 50 | — | 100 | 50 |
| 45 | — | — | >90 | — | — | >80 |

EXAMPLE 2

A solid form of cellulase was prepared as follows: 17 grams of polyethylene glycol (PEG) 8000 was heated at 60°-64° C. until melted. Eight ml of Novo Celluclast ® 250 1 was added to the melted PEG 8000 and mixed thoroughly until a uniform color was observed. A 22 gauge needle was connected to a jacketed column with a piece of rubber tubing and temperature of the column was maintained at 56° C. The rubber tubing and needle were wrapped with heat tape (63°-65° C). The cellulase-PEG 8000 mixture was added to the column, and air was pumped through the column, pushing the mixture out from the column through the needle to form beads. The beads were cooled to room temperature and stored at this temperature until use.

The cellulase-containing beads (5.2 g) were dissolved in 200 ml of dionized distilled water in a 1 liter beaker. An equivalent concentration of liquid cellulase preparation was added to another beaker containing the same final volume. Charmin ® toilet paper (4.5 g) was added to each. The reaction mixtures were incubated at 22° C., and the rate of decomposition was estimated visually. The results are expressed as percent decomposition (Table 2).

TABLE 2

| Source of Cellulase Addition | % Decomposition over time (min) | | |
|---|---|---|---|
| | 15 | 20 | 30 |
| None | 0 | 0 | 0 |
| Liquid (3 units)[a] | 10 | 50 | 80 |
| Solid (3 units) | 5 | 30 | 75 |

[a]One unit is the amount of enzyme required to produce one micromole per minute reducing carbohydrate.

EXAMPLE 3

Glass sink traps (1½ inches internal diameter) were clogged with 15 g of Charmin ® toilet paper. Two hundred ml of cellulase solution (3 units of Novo Celluclast ® 250 1 in 200 ml tap water, pH 6.4) were added to the pipes stuffed with toilet paper. After a designated incubation period, the traps were flushed with 1 liter of water. After 30 minutes incubation it took 3 minutes and 45 seconds, to clear the toilet paper clog. After 90 minutes incubation, it took 56 seconds to clear the toilet paper clog. In contrast, the control pipe which was not treated with enzyme took 12 minutes and 2 liters of water to flush out the occlusion.

EXAMPLE 4

A toilet (model number 738.492231) of the reverse trap type was purchased from Sears, Roebuck and Co., Chicago, Illinois. Approximately one-half roll of Sof-Knit 198 ® toilet paper was added to the toilet bowl, and the toilet was flushed. (The toilet paper was added as approximately eight sheet bundles). This was repeated until the toilet was clogged such that it would no longer drain properly or until the toilet overflowed after flushing. Fifteen grams of Cellulase Tv Concentrate® (Miles Laboratories) was dissolved in 300 ml of water, and the enzyme solution was added to the bowl. The pH and temperature of the water were 6.5 and 20° C., respectively. The enzyme was incubated for 1 hour under these conditions. The toilet was then flushed, resulting in the dissolution of the toilet paper obstruction. In some cases, the toilet had to be flushed two times to remove the occlusion. In control experiements, the toilet was clogged with toilet paper and flushed 1 hour later. The toilet remained occluded even after repeated flushing. The addition of 15 g of Cellulase Tv Concentrate to this toilet followed by 45 minutes incubation resulted in immediate clearing of the occlusion after one flush.

EXAMPLE 5

A clogged toilet of the washdown type in a ladies' bathroom was flushed three times without successful clearing of the obstruction. Seventy grams of Cellulase Tv Concentrate® was added to the toilet. After one hour, subsequent flushing resulted in the removal of the obstruction, resulting in normal water flow and toilet operation.

What is claimed is:

1. A method for unclogging drainage pipes blocked by cellulosic paper materials which comprises contacting the paper with a thickened fluid composition comprising from about 5% to about 20% by weight of a cellulase enzyme and from about 0.1% to about 1.0% of a non-cellulosic, water-soluble gum at a pH of 4.5 to 8.5, the cellulase enzyme being present in an amount sufficient to digest the cellulose in the paper.

2. A method as claimed in claim 1, wherein said non-cellulosic, water-soluble natural or synthetic gum is selected from the group consisting of xanthan gum, gum arabic, tragacanth gum, locust bean gum, guar gum, carrageenan, pectin, dextran, propyleneglycol alginate, carboxymethyl locust bean gum, carboxymethyl guar gum, fluid ethylene oxide polymers and polyethyleneimine.

* * * * *